US010091569B1

(12) United States Patent
Paes et al.

(10) Patent No.: US 10,091,569 B1
(45) Date of Patent: Oct. 2, 2018

(54) SMART MICROPHONE DEVICES, SYSTEMS, APPARATUSES, AND METHODS

(71) Applicant: Louroe Electronics, Van Nuys, CA (US)

(72) Inventors: Wayne Anthony Paes, Reseda, CA (US); Mark Edward Trainer, Northridge, CA (US)

(73) Assignee: Louroe Electronics, Van Nuys, CA (US)

( * ) Notice: Subject to any disclaimer, the term of this patent is extended or adjusted under 35 U.S.C. 154(b) by 0 days.

(21) Appl. No.: 15/783,839

(22) Filed: Oct. 13, 2017

(51) Int. Cl.

| | |
|---|---|
| ***H04R 1/04*** | (2006.01) |
| ***H04R 1/32*** | (2006.01) |
| ***H04R 3/00*** | (2006.01) |
| *H04R 29/00* | (2006.01) |

(52) U.S. Cl.
CPC ..... *H04R 1/04* (2013.01); *H04R 1/326* (2013.01); *H04R 3/00* (2013.01); *H04R 29/00* (2013.01); *H04R 2420/09* (2013.01)

(58) Field of Classification Search
CPC ..... G05B 19/406; G05B 2219/24015; H04R 1/326; H04R 2227/003; H04R 1/1041; H04W 12/08; G08B 19/00; G08B 13/1672; G08B 25/14; G08B 13/19602; G08B 13/19697; G08B 13/2491; G08B 19/005; G08B 21/02
See application file for complete search history.

(56) References Cited

U.S. PATENT DOCUMENTS

| | | | | |
|---|---|---|---|---|
| 4,355,213 | A * | 10/1982 | Marsh | H04R 1/08 181/208 |
| 9,363,091 | B2 | 6/2016 | Kanan et al. | |
| 9,602,673 | B2 | 3/2017 | Boyden et al. | |
| 2006/0104312 | A1* | 5/2006 | Friar | G08B 1/08 370/506 |
| 2006/0132302 | A1* | 6/2006 | Stilp | G05B 9/03 340/539.22 |
| 2007/0092097 | A1* | 4/2007 | Williams | H04R 1/023 381/355 |

(Continued)

FOREIGN PATENT DOCUMENTS

| | | | |
|---|---|---|---|
| CN | 201185430 | Y | 1/2009 |
| CN | 205373874 | U | 7/2016 |
| WO | WO-2016/098315 | A1 | 6/2016 |

OTHER PUBLICATIONS

"Canon Launches Two Network Cameras with Two-Way Audio Communication, Built-In Servers and 26X Zoom Lenses and More; New VB-C50FSi Fixed Camera Features Power Over Ethernet; New VB-C50i/VB-C50iR Pan/Tilt/Zoom Camera Offers Enhanced Functionality", Business Wire: Aug. 31, 2005.

*Primary Examiner* — Mohammad Islam
(74) *Attorney, Agent, or Firm* — Foley & Lardner LLP

(57) ABSTRACT

Examples described herein relate to systems, apparatuses, and methods for a microphone device that includes a microphone configured to output sound data signals, a first circuit board configured to perform audio analytics on the sound data signals, a second circuit board configured to extract power for powering the first circuit board, a housing configured to contain the microphone, the first circuit board, and the second circuit board, and an Ethernet interface configured to connect the second circuit board to a security system through an Ethernet connection.

23 Claims, 3 Drawing Sheets

(56) References Cited

U.S. PATENT DOCUMENTS

| | | | | |
|---|---|---|---|---|
| 2009/0027498 | A1* | 1/2009 | Owen | H04N 7/183 348/151 |
| 2009/0115570 | A1* | 5/2009 | Cusack, Jr. | G07C 9/00103 340/5.2 |
| 2009/0203355 | A1* | 8/2009 | Clark | G06F 21/32 455/411 |
| 2010/0201515 | A1* | 8/2010 | Fleming | H04L 67/125 340/539.23 |
| 2011/0169950 | A1* | 7/2011 | Weaver | G08B 13/1966 348/143 |
| 2014/0067137 | A1* | 3/2014 | Amelio | H03K 17/00 700/286 |
| 2014/0098235 | A1* | 4/2014 | Cusack, Jr. | G07C 9/00103 348/156 |
| 2015/0112678 | A1* | 4/2015 | Binks | G10L 25/48 704/236 |
| 2015/0177800 | A1* | 6/2015 | Kanan | H04L 12/40045 713/300 |
| 2015/0194045 | A1 | 7/2015 | Edwards et al. | |
| 2015/0317170 | A1* | 11/2015 | Henderson | G06F 3/04842 713/100 |
| 2016/0164432 | A1 | 6/2016 | Weatherspoon | |
| 2017/0078810 | A1* | 3/2017 | Lee | H04R 27/00 |
| 2017/0099374 | A1* | 4/2017 | Peters | H04M 1/0297 |
| 2017/0111085 | A1* | 4/2017 | Pera | H04B 3/54 |
| 2017/0264999 | A1* | 9/2017 | Fukuda | H04R 1/406 |

* cited by examiner

SMART MICROPHONE DEVICES, SYSTEMS, APPARATUSES, AND METHODS

BACKGROUND

The present disclosure relates to a microphone device that detects sound events and, in particular examples, to a microphone device for or in a security system. One example of a microphone for a security system is the Verifact® A product made by Louroe Electronics. The Verifact® A product is an omni-directional microphone within a housing that is configured to mount to a call or ceiling surface.

SUMMARY

In some arrangements, a microphone device, includes a microphone configured to output sound data signals, a first circuit board configured to perform audio analytics on the sound data signals, a second circuit board configured to extract power for powering the first circuit board, a housing configured to contain the microphone, the first circuit board, and the second circuit board, and an Ethernet interface configured to connect the second circuit board to a security system through an Ethernet connection.

In some arrangements, the first circuit board is separate from the second circuit board.

In some arrangements, the microphone is directly connected to or mounted on the second circuit board.

In some arrangements, the Ethernet interface is mounted on the second circuit board.

In some arrangements, the microphone device further includes a power extractor mounted on the second circuit board. The power extractor is operatively coupled to the Ethernet interface to extract power from the Ethernet connection.

In some arrangements, the power extractor is configured to power the microphone.

In some arrangements, the power extractor is configured to power the first circuit board.

In some arrangements, each of the first circuit board and the second circuit board includes a data port for exchanging the sound data signals and analytic results determined from the audio analytics.

In some arrangements, the second circuit board is configured to send the sound data signals to the first circuit board for performing the audio analytics.

In some arrangements, the first circuit board is configured to send analytic results determined from the audio analytics to the second circuit board.

In some arrangements, the first circuit board includes a general purpose processor and a memory, the memory is configured to store audio analytic software, and the general purpose processor is configured to execute the audio analytic software to perform the audio analytics.

In some arrangements, Ethernet interface is configured to send the sound data signals and analytic results determined from the sound data signals to the security system.

In some arrangements, the microphone is recessed within the housing.

In some arrangements, the microphone is aligned with an aperture in the housing.

In some arrangements, housing includes at least one of a grommet, O-ring, or lip structure around the aperture to provide a channel to the microphone.

In some arrangements, a method for providing a microphone device includes providing a microphone configured to output sound data signals, providing a first circuit board configured to perform audio analytics on the sound data signals, providing a second circuit board configured to extract power for powering the first circuit board, providing a housing configured to contain the microphone, the first circuit board, and the second circuit board, and providing an Ethernet interface configured to connect the second circuit board to a security system through an Ethernet connection.

In some arrangements, a microphone device, includes a microphone configured to capture sound and to output sound data signals, a housing, wherein the microphone is recessed within the housing and aligned with an aperture of the housing, and at least one of a grommet, O-ring, or lip structure arranged around the aperture to provide a channel to the microphone to capture the sound.

In some arrangements, the microphone device further includes a first circuit board configured to perform audio analytics on the sound data signals to determine analytic results, and an Ethernet interface configured to connect to a security system through an Ethernet connection, wherein the microphone device is configured to send the sound data signals and the analytic results to the security system.

In some arrangements, the first circuit board is powered by power extracted from the Ethernet connection.

In some arrangements, the microphone is directly connected to or mounted on a second circuit board that is separate from the first circuit board. The first circuit board and the second circuit board are connected via an internal Ethernet connection.

DETAILED DESCRIPTION

Referring to the FIGS. generally, systems, apparatuses, and methods described herein relate to a smart microphone device configured for analyzing audio data signals to detect certain types of sound events such as but not limited to, a gun-shot, breaking glass, loud/aggressive voice, and the like. The microphone device may be contained in a device housing that is connectable to an Ethernet network. In particular, the microphone device (which possesses both the microphone and the audio analytic capabilities) may be contained and supported by a single housing that is connectable to the Ethernet network through an Ethernet interface (e.g., a single Ethernet connection port). The microphone device may include additional interfaces (e.g., ports) for connecting to local devices such as but not limited to, cameras, additional external microphones, speakers, external auxiliary power source, momentary relay, and the like. The single device housing may be configured to be mounted to a suitable location such as but not limited to, in or on a ceiling, wall, or another structure. By incorporating the Ethernet connectable microphone device and associated electronics within a single, relatively small housing having an Ethernet connection port, the housing with the microphone device may be readily mounted in any suitable location and position to maximize reception of audio from a specific area or environment, for example, from a specific area or environment for which security or other audio monitoring needs are desired. In addition, the housing may be configured or mounted (or both) to be inconspicuous or hidden, yet connected (via a single Ethernet connection) to other portions of a computerized security system. In further examples, a computerized security system may include or operate with a two or more microphone devices, each contained within a different respective housing and mounted at a different respective location relative to each other microphone device connected in or to the system.

Figure 1:
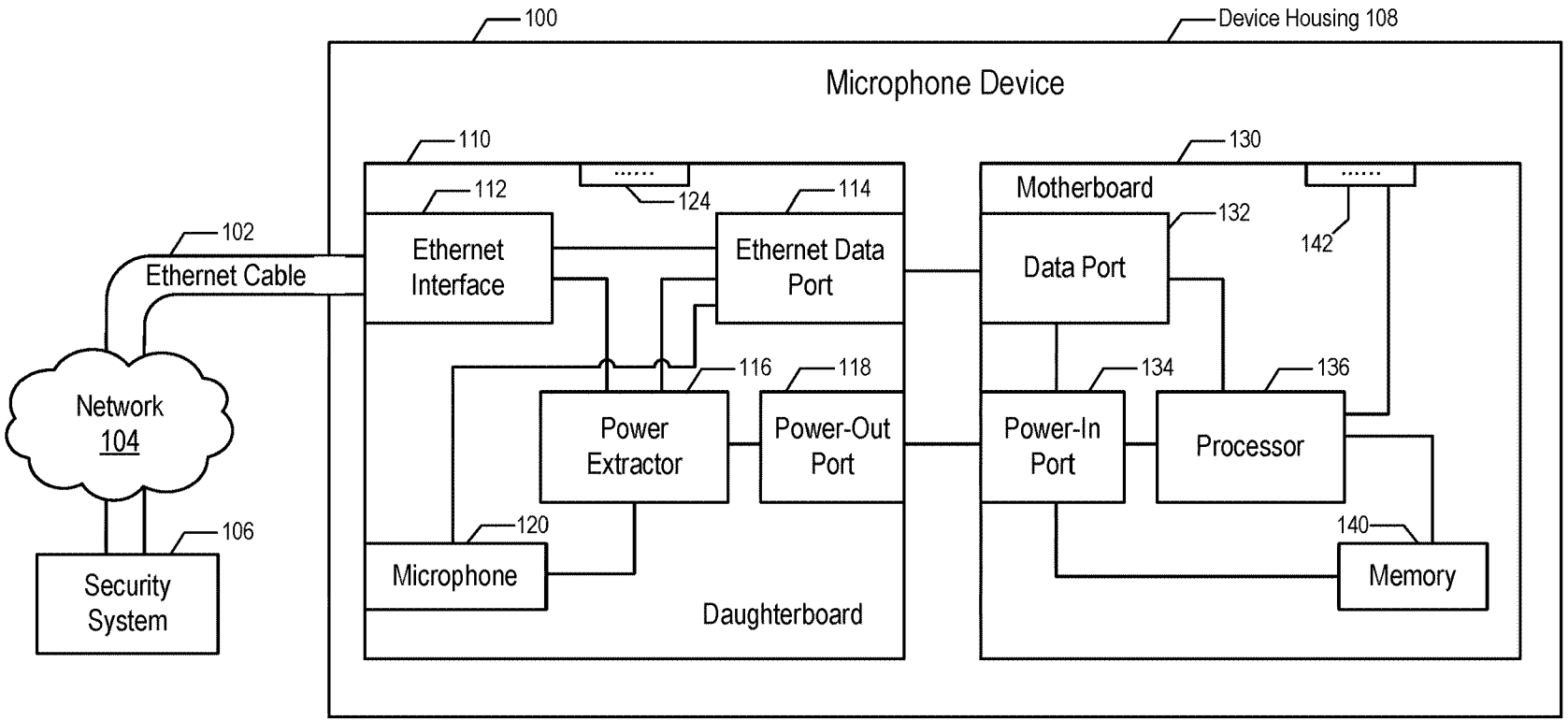
FIG. 1 is a schematic diagram of a microphone device according to various implementations described herein.

FIG. 1 is a schematic diagram of a microphone device 100 according to various example implementations. Referring to FIG. 1, the microphone device 100 is shown to have an electronic system, which includes a motherboard 130 and a daughterboard 110. In other examples, the electronic system may include other components, depending on the field of use. The motherboard 130 and the daughterboard 110 may be contained in a same device housing 108. In some examples, the device housing 108 may include a top shell portion and a base portion that couple together to enclose an interior volume in which the motherboard 130 and the daughterboard 110 are contained, partially or fully. In particular examples, the device housing 108 may completely enclose and completely support both the motherboard 130 and the daughterboard 110, and any other components included in the housing. The device housing 108 may be made from a suitably rigid material such as but not limited to, plastic, metal, ceramic, glass, and the like.

In some arrangements, the motherboard 130 and the daughterboard 110 may be separate (e.g., circuit boards that are supported within the device housing 108, in a spaced apart relation). The motherboard 130 may be a commercially available processor circuit board in some examples. By employing a processor motherboard 130 that is separate from the daughterboard 110, a commercially available processor circuit board may be employed as the motherboard 130, to reduce cost or manufacturing complexity (or both) of the microphone device 100. In other arrangements, at least a portion of the motherboard 130 and at least a portion of the daughterboard 110 may be connected or shared.

The daughterboard 110 may provide Ethernet connection capabilities (including extraction of data and power from an Ethernet connection) for the motherboard 130, such that the motherboard 130 need not, itself, include Ethernet data and power extraction capabilities (and, thus, may be a commercially available processor board). In addition, the daughterboard 110 may provide the motherboard 130 with audio data signals corresponding to audio sound captured in a local vicinity of the microphone device 100 and the device housing 108. For instance, a microphone 120 may be mounted on the daughterboard 110 to capture audio sound in the local vicinity of the microphone device 100 and the device housing 108. The microphone 120 may be mounted on the same circuit board (e.g., the daughterboard 110) as that on which other components (e.g., an Ethernet interface 112, a power extractor 116, an Ethernet data port 114, a power out port 118, and the like) are mounted. In other examples, the microphone 120 may be mounted within the housing 108, but separate from and electrically connected to the daughterboard 110. The microphone 120 may convert audio sound into output signals to the audio data signals.

In some configurations, the microphone 120 may be operatively coupled to the data port 114. The microphone 120 may output the audio data signals to the data port 114, such that the data port 114 can provide the audio data signals to the motherboard 130 (e.g., to a data port 132 of the motherboard 130) in the manner described. The motherboard 130 includes a processor 136 operatively coupled (e.g., via a conductor, a wire, a conductive trace, or the like) to the data port 132, to receive the audio data signals outputted by the microphone 120. The processor 136 may analyze the audio data signals to detect the sound events in a manner as described herein.

In some examples, the microphone 120 may be an omnidirectional microphone that can capture sound from any direction. In some examples, the microphone 120 may be a unidirectional microphone that can capture sound from a predefined direction. In some examples, the microphone 120 may be a microphone of any other polarization pattern. In some examples, the microphone 120 may represent a plurality of microphones. The microphones may be arranged to abut or be adjacent to one another, or may be arranged to be separate from one another.

While in the non-limiting example shown in FIG. 1, the microphone 120 is mounted on the daughterboard 110, one of ordinary skill in the art can appreciate that the microphone 120 may also be directly or indirectly connected to the daughterboard 110. For example, the microphone 120 may be an auxiliary microphone not directly mounted on the daughterboard 110, but may be operatively coupled to the daughterboard 110 via a wired or wireless connection. In some configurations, the microphone 120 may be mounted on another support structure on or in the device housing 108, and connected to the daughterboard 110 by wire (or another electrical conductor) or connected to the daughterboard 110 wirelessly.

In some arrangements, the device housing 108 may include an opening or aperture aligned with the microphone 120. Audio sound may pass through the opening or aperture, to the microphone 120, without obstruction. In some examples, the microphone 120 may be recessed within the device housing 108. In some examples, the device housing 108 may include a lip, a grommet, an O-ring, or another structure around the opening or aperture, to provide a channel through which audio sound in the external vicinity of the device housing 108 may be directed to the microphone 120. In particular examples, a grommet or O-ring having a toroidal shape or a semi-toroidal shape is employed.

In some arrangements, the microphone 120 may be of a selected type/model and may have a selected frequency response characteristics. The microphone 120 may be installed and fixed in the device housing 108 and/or on the daughterboard 110 at the point of manufacture of the device 100. In some arrangements, the microphone 120 may be connected to or mounted on the daughterboard 110 with a conductor, a wire, a conductive trace, or the like that is set at the point of manufacture. Furthermore, the dimensions and shapes of the aperture in which the microphone 120 is recessed may also be selected at the point of manufacture. Because one or more (or all) of the microphone frequency characteristics, microphone recess depth within the housing 108, and microphone position relative to the opening in the grommet or O-ring may be selected and set at the point of manufacture, calibration of sensitive audio analytics software (e.g., at the motherboard 130) to the microphone 120 can be carried out at the factory with improved accuracy, as compared to audio systems in which a type of microphone as well as a type and a length of connection may be selected by the end user or may otherwise vary from device-to-device or for different use environments.

The daughterboard 110 may be configured to connect the motherboard 130 to an Ethernet network connection. For instance, the daughterboard 110 may include the Ethernet interface 112 mounted thereon. The Ethernet interface 112 may be configured to connect to a network 104 via an Ethernet cable 102. An example of the Ethernet interface 112 may be an Ethernet port, jack, or socket. In some examples, the network 104 may be a Local Area Network (LAN), Metropolitan Area Network (MAN), Wide Area Network (WAN), or another suitable network connecting the microphone device 100 and a security system 106. In some arrangements, the Ethernet cable 102 may connect to a modem or a router, which in turn connects to the network 104. In other arrangements, the Ethernet cable 102 may be directly connected to the security system 160. In some examples, the Ethernet interface 112 may include suitable hardware, firmware, and software used for communicating via the network 104. While a wired connection (e.g., via the Ethernet cable 102) is shown, one of ordinary skill in the art can appreciate that wireless connections to the network 104 can be likewise implemented.

The security system 106 may be a computing system capable of receiving, storing, analyzing, and/or displaying the audio data signals (outputted by the microphone 120 of the daughterboard 110) and the analytic results (determined by the processor 136 of the motherboard 130). In some arrangements, the security system 106 may be located (e.g., in another room relative to the device housing 108, at a remote location, at a data or security management facility, and the like), and need not be within the local vicinity of the microphone device 100. In other arrangements, the security system 106 may be located within the local vicinity of the microphone device 100. The security system 106 may be a suitable computing device such as but not limited to, a desktop computer, a server, a smart phone, a mobile device, a tablet, a laptop, a personal digital assistant, a wearable device, and the like, configured or otherwise programmed to carry out functions as described herein. The security system 106 may include one or more of a processor, a memory, a network device (to connect to the network 104), a display device (e.g., a screen), and one or more input/output devices (e.g., a touch screen, microphone, speaker, keyboard, and the like) for receiving user input.

In some arrangements, the daughterboard 110 may include the power extractor 116 mounted thereon that is configured to extract power from signals received through the Ethernet cable 102, by the Ethernet interface 112. For example, the power extractor 116 may be operatively coupled (e.g., via a conductor, a wire, a conductive trace, or the like) to the Ethernet interface 112 to extract power from the Ethernet connection enabled by the Ethernet interface 112. The power can be extracted by the power extractor 116 in a manner such as but not limited to, U.S. Pat. No. 9,363,091, titled "POWER OVER ETHERNET DEVICES, SYSTEMS AND METHODS," which is hereby incorporated by reference in its entirety.

The power extractor 116 may provide power output signals to components of the daughterboard 110 and the motherboard 130. For example, the power extractor 116 may be operatively coupled (e.g., via a conductor, a wire, a conductive trace, or the like) to one or more of the Ethernet interface 112, the Ethernet data port 114, the microphone 120, or another suitable component mounted on or directly/indirectly coupled to the daughterboard 110. Alternatively, one or more of the Ethernet interface 112, the Ethernet data port 114, the microphone 120, or another suitable component mounted on or directly/indirectly coupled to the daughterboard 110 can be powered independently from an external power source different from the power extractor 116. In addition, the power extractor 116 may be operatively coupled (e.g., via a conductor, a wire, a conductive trace, or the like) to the power-out port 118 of the daughterboard 110, which is operatively coupled to a power-in port 134 of the motherboard 130, via a suitable wired or wireless connection. The power-in port 134 of the motherboard 130 may power the motherboard 130 and components mounted on or directly/indirectly coupled (e.g., via a conductor, a wire, a conductive trace, or the like) to the motherboard 130 in the manner described herein.

In some examples, the Ethernet interface 112 may communicate Ethernet signals (e.g. data signals) to and from the motherboard 130. For instance, the Ethernet interface 112 may be operatively coupled (e.g., via a conductor, a wire, a conductive trace, or the like) to the Ethernet data port 114. An example of the Ethernet data port 114 may be an Ethernet port, jack, or socket. In some examples, the Ethernet data port 114 may be operatively coupled to the data port 132 on the motherboard 130 via an Ethernet cable or another suitable connection (e.g., a wire or the like). The data port 132 on the motherboard 130 may be operatively coupled (e.g., via a conductor, a wire, a conductive trace, or the like) to the processor 136 on the motherboard 130 in the manner described. The processor 136 may send or stream the analytic results to the data port 132 on the motherboard 130, which may relay the analytic results to the Ethernet data port 114 on the daughterboard 110. The Ethernet data port 114 may convey the analytic results to the Ethernet interface 112 such that the Ethernet interface 112 may send or stream the analytic results and the audio data signals (based on which the analytic results are determined) together to the security system 106 via the network 104.

In some arrangements, the audio data signals may be assigned timestamps and/or sequence numbers by the daughterboard 110 (e.g., by a suitable processing unit (not shown) mounted on the daughterboard 110 or by the microphone 120) as the audio data signals are generated by the microphone 120 based on the captured sound. In alternative arrangements, the audio data signals may be assigned timestamps and/or sequence numbers by the processor 136 on the motherboard 130, as the processor 136 receives the audio data signals for performing audio analytics. Responsive to the processor 136 detecting a certain sound event, the timestamp(s) and/or sequence number(s) that correspond to the relevant portions of the audio data signals that are associated with the detected sound event may be recorded or otherwise noted, and sent with analytic results to the daughterboard 110 to be relayed to the security system 106 together. Thus, in some arrangements, the daughterboard 110 may send to the security system 106 the audio data signals, as well as the analytic results, and the timestamps and/or sequence numbers that indicate mapping or correspondence between the audio data signals and analytic results.

In some arrangements, an audio enhancement circuitry (not shown) such as but not limited to, a noise or echo cancelling circuitry, and the like, may be provided on the daughterboard 110 for enhancement of the audio data signals outputted by the microphone 120. In other arrangements, an audio enhancement circuitry (not shown) such as but not limited to, a noise or echo cancelling circuitry, and the like, may be provided between the Ethernet data port 114 on the daughterboard 110 and the data port 132 on the motherboard 110, for enhancement of the audio data signals passed between the Ethernet data port 114 and the data port 132. In such arrangements, the audio enhancement circuitry may be separate from the daughterboard 110 and the motherboard 130.

The motherboard 130 may include the processor 136 operatively coupled (e.g., via a conductor, a wire, a conductive trace, or the like) to a memory 140. In some arrangements, the processor 136 may be implemented with a general-purpose processor. In particular examples, the processor 136 may be a conventional, general-purpose, and programmable processor. In such examples, the motherboard 130 may be a conventional, general purpose, programmable processor board available (e.g., a commercially available board manufactured by a suitable manufacturer). The ability to employ an available, conventional general purpose processor board as the motherboard 130 can reduce the manufacturing complexity and cost of the microphone device 100. In other examples, the motherboard 130 may be a dedicated circuit, configured specifically for the microphone device 100. In particular arrangements, the processor 136 may be implemented with an Application Specific Integrated Circuit (ASIC), one or more Field Programmable Gate Arrays (FPGAs), a Digital Signal Processor (DSP), a group of processing components, or other suitable electronic processing components.

The memory 140 (e.g., Random Access Memory (RAM), Read-Only Memory (ROM), Non-volatile RAM (NVRAM), Flash Memory, hard disk storage, etc.) stores data and/or computer code for facilitating at least some of the various processes described herein. The memory 140 includes tangible, non-transient volatile memory, or non-volatile memory. The memory 140 stores programming logic that, when executed by the processor 136, controls the operations of the motherboard 130.

In some arrangements, audio analytics software may be stored in the memory 140 (or hardware, firmware, and/or the like associated with the processor 136) on the motherboard 130. The audio analytics software can provide the processor 136 with an ability to analyze audio data signals received by the processor 136 from the data port 132, for detection of certain types of sound events. In some arrangements, the processor 136 can be enabled by the audio analytics software to output analytic results (e.g., signals) to the data port 132 on the motherboard 130, to be relayed to the daughterboard 110, which may forward the analytic results to the security system 106. For example, the audio analytics software can provide the processor 136 with the ability to output a signal (through the data port 132) indicating that a particular or pre-defined sound event has been detected. In some arrangements, the audio analytics software can provide the processor 136 with the ability to output a signal (through the data port 132), indicating detection of a particular or pre-defined type of sound events (such as but not limited to, sound of a gun-shot, breaking glass, loud/aggressive voice, spay-paint can ball rattle, and the like). As such, the analytic results can represent warnings to the security system 106 that a certain type of sound events has likely or possibly occurred.

In further implementations, additional software, firmware, and/or hardware may be included to provide the processor 136 with the ability to process and analyze data from other external devices (external to the device housing 108) and/or control such other external devices. Examples of such external devices include but not limited to, local cameras, additional external microphones, speakers, and the like, that may be connected to the motherboard 130 through suitable interfaces (e.g., data ports) or connection pins 142. In some arrangements, the connection pins 142 may be connected to the processor 136 to receive data from the other external devices.

In the arrangements in which the motherboard 130 may be a commercially available circuit board, the motherboard 130 may also include other components such as but not limited to, the connection pins 142 for connection to other circuit boards (e.g., to pin connectors mounted on the other circuit boards), external devices, and the like. Such other components may be present on the motherboard 130 depending on the manufacturer or model of the motherboard 130. The daughterboard 110 may include other components such as but not limited to, the connection pins 124 for connection to other circuit boards (e.g., to pin connectors mounted on the other circuit boards), external devices, and the like.

As described, the Ethernet data port 114 on the daughterboard 110 and the data port 132 on the motherboard 130 may be connected and employed to exchange the sound data signals and the analytic results between the motherboard 130 and the daughterboard 110. The Ethernet data port 114 and the data port 132 may be connected through an internal connection, such as an internal Ethernet data connection within the device housing 108, or by another suitable connection. The daughterboard 110 may be configured to send the sound data signals to the motherboard 130 through the internal connection, for performing the audio analytics by the motherboard 130. The motherboard 130 may be configured to send the analytic results to the daughterboard 110 through the internal connection, for relaying such results to the security system 106.

The power-in port 134 on the motherboard 130 may be coupled to receive electrical power, to provide power to components of the motherboard 130. For example, the power-in port 134 on the motherboard 130 may be connected to receive power from the power-out port 118 on the daughterboard 110, which receives the power from the Ethernet connection, via the power extractor 116 on the daughterboard 110. Illustrating with a non-limiting example, the power-in port 134 may be operatively coupled (e.g., via a conductor, a wire, a conductive trace, or the like) to one or more of the data port 132, the processor 136, the memory 140, and the like, to provide electrical power to each of those components of the motherboard 130.

Figure 2:
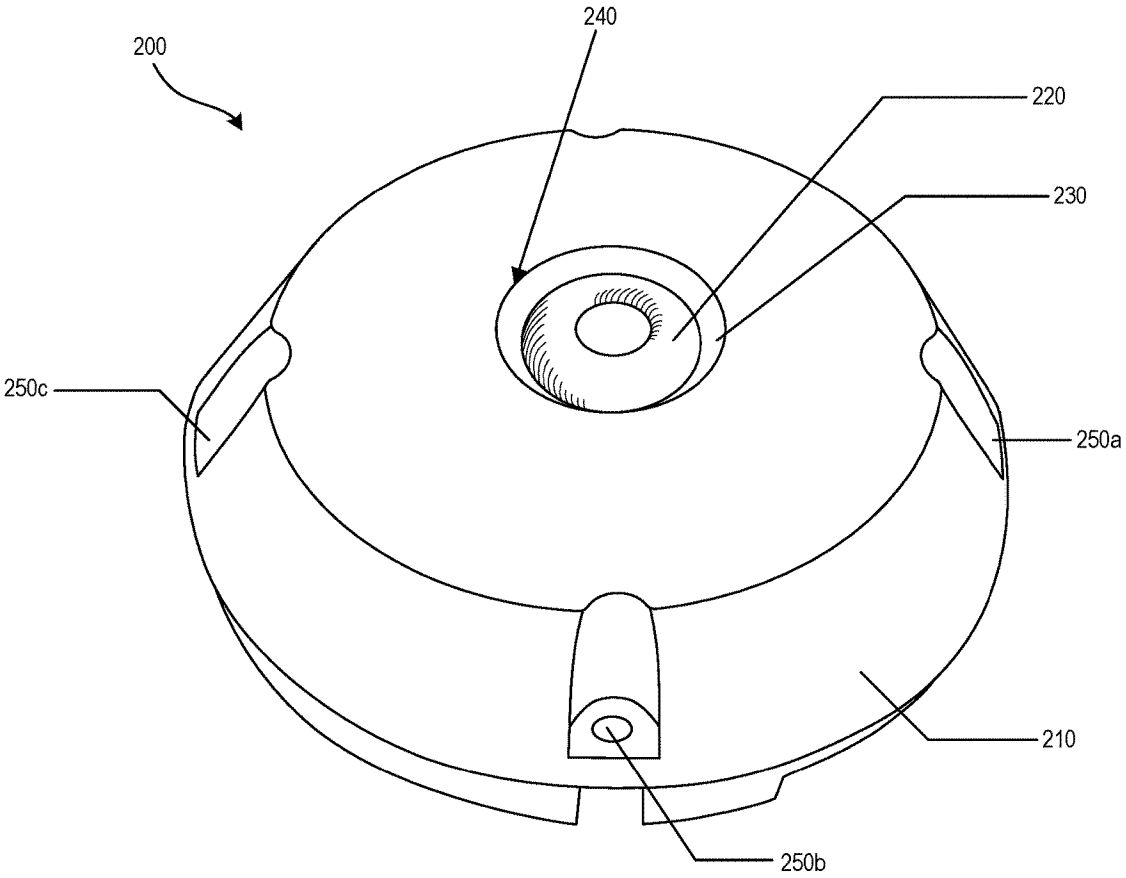
FIG. 2 illustrates a perspective view of a microphone device according to various implementations described herein.
Figure 3:
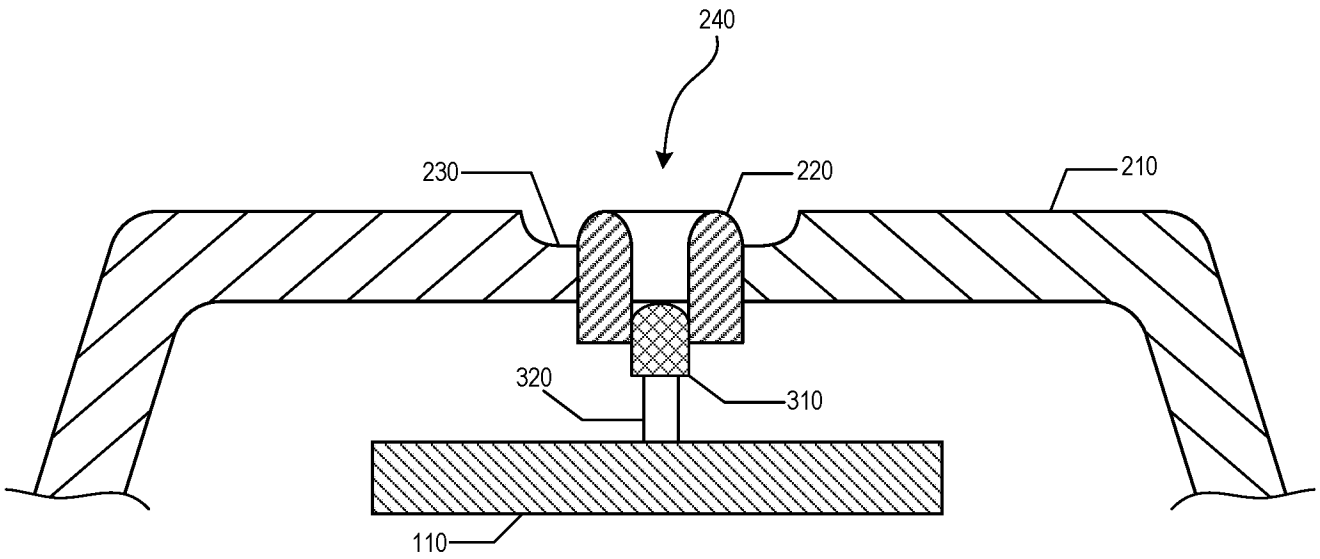
FIG. 3 illustrates a cross-section view of a structure for supporting a microphone of a microphone device according to various implementations described herein.

FIG. 2 illustrates a perspective view of a microphone device 200 according to various implementations described herein. FIG. 3 illustrates a cross-section view of a structure for supporting a microphone 310 of the microphone device 200 (FIG. 2) according to various implementations described herein. Referring to FIGS. 1-3, the microphone device 200 may be a particular implementation of the microphone device 100. The microphone device 200 may have a device housing 210 that corresponds to the device housing 108 and encloses a motherboard (e.g., the motherboard 130) and a daughterboard (e.g., the daughterboard 110). The device housing 210 may include attachment structures 250*a*-250*c* to enable mounting of the microphone device 200 at a suitable location in a room, hallway, station, airport, or another environment, for example, on a wall, ceiling, column or other support structure. In the non-limiting shown in FIG. 2, each of the attachment structures 250*a*-250*c* may include screw holes and screws for attaching the microphone device 200 to a suitable surface. One of ordinary skill in the art can appreciate that other attachment elements such as but not limited to, bolts, nails, hook and loop fastener material such as VELCRO®, adhesives, stands, clips, clamps, and the like can be implemented based on intended usage. The microphone 310 may be supported by a support structure. In some arrangements, the microphone 310 may be separated from the daughterboard 110. The microphone 310 may be connected to the daughterboard 110 via an electronic connection (e.g., a 2-conductor wire connection 320). The microphone 310 may not be directly mounted on the daughterboard 110. Alternatively, the microphone 310 may be located in other suitable locations within the housing 210. For example, the microphone 310 may be directly mounted on the daughterboard 110 and may be structurally supported by the daughterboard 110.

The device housing 210 may include a wall 230 that forms an aperture 240. The aperture 240 may be an opening aligned with the microphone 310 (such as but not limited to the microphone 120). As such, the microphone 310 may be recessed below the opening, within the device housing 210. In some arrangements, the device housing 210 may include a lip, a grommet, an O-ring, or another structure around the aperture 240 to provide a channel through which audio sound in the external vicinity of the device housing 210 may be directed to the microphone 310 without obstruction. As shown in the non-limiting example of FIG. 2, a toroidal, ring-shaped grommet 220 arranged in the aperture 240 may have a through hole that forms a channel leading to the recessed microphone 310. While in the non-limiting example shown in FIG. 2, the grommet 220 may have a cross section that has a rounded end (e.g., a portion that is exposed to the exterior of the device housing 210), the cross section of the grommet 220 may have other shapes (e.g., ellipse, rectangle, square, cone, and the like). In some arrangements, the microphone 310 is installed and/or inserted into the grommet 220.

A width of the grommet 220 may define a depth of the channel through which audio sound in the external vicinity of the device housing 210 may be directed to the microphone 310 without obstruction. In other words, the width of the grommet 220 may create a depth from an exterior of the device housing 210 or an opening of the aperture 240 to the microphone 310. In some arrangements, the microphone 310 may be directly below the grommet 220 or the channel formed by the grommet 220 to capture sound passed through the channel. The microphone 310 may be aligned with the channel formed by the grommet 220. At least a portion of the microphone 210 may abut at least a portion of the grommet 220 in some examples. In other example, the microphone 210 may be separate and spaced part from the grommet 220.

The grommet 220 may be supported by the wall 230. In some arrangements, the grommet 220 may have a frictional fit to the wall 230. In some arrangements, the grommet 220 may be attached to the wall 230 by adhesives. In other arrangements, the grommet 220 may be attached to the wall 230 via at least one screw or other elements of attachment. The dimensions of the grommet 220 (e.g., the dimensions of the channel leading to the microphone 310) and the aperture 240 as well as the response of the microphone 310 may be set based on frequency responses of the sound events intended to be detected. In particular, the shape of the cross section of the grommet 220 and the width of the grommet 200 can affect the manner in which the sound from the exterior of the device housing 210 is propagated through the channel to the microphone 310. Thus, the shape of the cross section of the grommet 220 and the width of the grommet 200 can be designed differently based on the characteristics of sound that the microphone 310 is intended to capture.

For example, a frequency response for a typical gunshot sound event may be within the range of approximately 7 KHz-9 KHz. To enhance the frequency response of the microphone 310 in that frequency range, the grommet 220 with a designated width (e.g., 2 mm) and a designated shape (e.g., a rounded, toroid shape) may be used for shaping an appropriate channel.

The various examples illustrated and described are provided merely as examples to illustrate various features of the claims. However, features shown and described with respect to any given example are not necessarily limited to the associated example and may be used or combined with other examples that are shown and described. Further, the claims are not intended to be limited by any one example.

The foregoing method descriptions and the process flow diagrams are provided merely as illustrative examples and are not intended to require or imply that the steps of various examples must be performed in the order presented. As will be appreciated by one of skill in the art the order of steps in the foregoing examples may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm steps described in connection with the examples disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. The hardware used to implement the various illustrative logics, logical blocks, modules, and circuits described in connection with the examples disclosed herein may be implemented or performed with a general purpose processor, a DSP, an ASIC, a FPGA or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some steps or methods may be performed by circuitry that is specific to a given function.

In some exemplary examples, the functions described may be implemented in hardware, software, firmware, or any combination thereof. If implemented in software, the functions may be stored as one or more instructions or code on a non-transitory computer-readable storage medium or non-transitory processor-readable storage medium. The steps of a method or algorithm disclosed herein may be embodied in a processor-executable software module which may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable storage media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disk and disc, as used herein, includes CD, laser disc, optical disc, digital versatile disc DVD, floppy disk, and blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable storage medium and/or computer-readable storage medium, which may be incorporated into a computer program product.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout the previous description that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. A microphone device, comprising:

a microphone configured to output sound data signals;

a first circuit board configured to perform audio analytics on the sound data signals;

a second circuit board configured to extract power and to provide at least some of the power for powering the first circuit board, the second circuit board being a separate circuit board relative to the first circuit board;

a housing containing the first circuit board and the second circuit board; and an Ethernet interface configured to connect the second circuit board to a security system through an Ethernet connection.

2. The microphone device of claim 1, wherein the first circuit board and the second circuit board are supported within the housing in a spaced apart relation to each other.

3. The microphone device of claim 1, wherein the microphone is directly connected to or mounted on the second circuit board.

4. The microphone device of claim 3, wherein the Ethernet interface is mounted on the second circuit board.

5. The microphone device of claim 4, further comprising a power extractor mounted on the second circuit board, wherein the power extractor is operatively coupled to the Ethernet interface to extract power from the Ethernet connection.

6. The microphone device of claim 5, wherein the power extractor is configured to power the microphone.

7. The microphone device of claim 5, wherein the second circuit board has a power output port, the first circuit board has a power input port coupled to the power output port of the second circuit board, and wherein the power extractor is connected to the power output port of the second circuit board and configured to provide power to the first circuit board, through the power input port on the first circuit board.

8. The microphone device of claim 1, wherein the second circuit board has a data port, and wherein the first circuit board has a data port coupled to the data port of the second circuit board, for exchanging the sound data signals and analytic results determined from the audio analytics.

9. The microphone device of claim 8, wherein the microphone is directly connected to or mounted on the second circuit board and wherein the second circuit board is configured to send the sound data signals to the first circuit board for performing the audio analytics.

10. The microphone device of claim 9, wherein the first circuit board is configured to send analytic results determined from the audio analytics to the second circuit board.

11. The microphone device of claim 1, wherein the first circuit board comprises a general purpose, programmable processor and a memory;

the memory is configured to store audio analytic software; and the general purpose processor is configured to execute the audio analytic software to perform the audio analytics.

12. The microphone device of claim 1, wherein Ethernet interface is configured to send the sound data signals and analytic results determined from the sound data signals to the security system.

13. The microphone device of claim 1, wherein the microphone is recessed within the housing, and wherein the housing has an aperture, and wherein the housing includes at least one of a grommet, an O-ring, or a lip structure around the aperture, that has a channel through which audio sound from outside of the housing may be directed to the microphone, the channel extending from an opening in the grommet, the O-ring, or the lip structure to the microphone.

14. The microphone device of claim 1, wherein the microphone is located within the housing, wherein the housing includes a toroidal, ring-shaped grommet having a through hole that forms a channel leading from an opening in the grommet, to the microphone.

15. The microphone device of claim 14, wherein the grommet has a rounded end around the opening and facing outward from the housing.

16. A method for providing a microphone device, comprising:

providing a microphone configured to output sound data signals;

providing a first circuit board configured to perform audio analytics on the sound data signals;

providing a second circuit board configured to extract power and to provide at least some of the power for powering the first circuit board, the second circuit board being a separate circuit board relative to the first circuit board;

containing the first circuit board and the second circuit board; and providing an Ethernet interface configured to connect the second circuit board to a security system through an Ethernet connection.

17. A microphone device, comprising:

a microphone configured to capture sound and to output sound data signals;

a housing, wherein the microphone is recessed within the housing and aligned with an aperture of the housing; and at least one of a grommet, O-ring, or lip structure arranged around the aperture to provide a channel to the microphone to capture the sound, the channel extending through the grommet, the O-ring, or the lip structure, from an opening in the grommet, the O-ring, or the lip structure to the microphone.

18. The microphone device of claim 17, further comprising:

a first circuit board configured to perform audio analytics on the sound data signals to determine analytic results; and an Ethernet interface configured to connect to a security system through an Ethernet connection, wherein the microphone device is configured to send the sound data signals and the analytic results to the security system.

19. The microphone of claim 18, wherein the first circuit board is powered by power extracted from the Ethernet connection.

20. The microphone of claim 18, wherein the microphone is directly connected to or mounted on a second circuit board that is separate from the first circuit board; and the first circuit board and the second circuit board are connected via an internal Ethernet connection.

21. The microphone device of claim 13, wherein at least one of a dimension of the channel, and a dimension of an opening of the channel is selected to enhance the frequency response of the microphone in the frequency range of 7-9 KHz.

22. The microphone device of claim 17, wherein at least one of a dimension of the channel, and a dimension of an opening of the channel is selected to enhance the frequency response of the microphone in the frequency range of 7-9 KHz.

23. The microphone device of claim 17, wherein the at least one of the grommet, the O-ring, or the lip structure is located around the aperture, and has a channel through which audio sound from outside of the housing may be directed to the microphone, the channel extending from an opening in the grommet, the O-ring, or the lip structure to the microphone.

* * * * *